US006698628B2

(12) United States Patent
Mascitelli

(10) Patent No.: US 6,698,628 B2
(45) Date of Patent: Mar. 2, 2004

(54) EXTENSION FOR BOTTLE DISPENSER, IN PARTICULAR FOR FOOD PRODUCTS

(75) Inventor: Francesco Mascitelli, Pescara (IT)

(73) Assignee: EMSAR S.p.A., S. Giovanni Teatino (CH) (IT)

( * ) Notice: Subject to any disclaimer, the term of this patent is extended or adjusted under 35 U.S.C. 154(b) by 83 days.

(21) Appl. No.: 10/148,261

(22) PCT Filed: Sep. 27, 2001

(86) PCT No.: PCT/IT01/00497

§ 371 (c)(1),
(2), (4) Date: May 29, 2002

(87) PCT Pub. No.: WO02/26584

PCT Pub. Date: Apr. 4, 2002

(65) Prior Publication Data

US 2002/0179650 A1 Dec. 5, 2002

(30) Foreign Application Priority Data

Sep. 29, 2000 (IT) ..... RM20000180 U

(51) Int. Cl.[7] ..... B65D 37/00
(52) U.S. Cl. ..... 222/491; 222/212; 222/494
(58) Field of Search ..... 222/212, 491, 222/494, 568

(56) References Cited

U.S. PATENT DOCUMENTS 3,184,781 A 5/1965 Hoxie
4,516,697 A * 5/1985 Dreps et al. ..... 222/212
4,815,637 A 3/1989 Nellis
4,938,621 A 7/1990 Pyrozyk
5,154,328 A * 10/1992 Gueret ..... 222/494
5,186,368 A * 2/1993 Garcia ..... 222/490
6,016,939 A * 1/2000 Gueret ..... 222/494

FOREIGN PATENT DOCUMENTS

DE 42 02 592 A1 8/1993
FR 2 785 878 5/2000

* cited by examiner

*Primary Examiner*—Joseph A. Kaufman
(74) *Attorney, Agent, or Firm*—Browdy and Neimark, P.L.L.C.

(57) ABSTRACT

Extension for bottle dispenser, in particular for food product, having a stopper part (10) to be applied on the mouth of the bottle and provided with a spout (11) curved downwards, comprising in a single piece: a conduit portion (20) in continuation of the cavity of the spout (11) into which can be inserted with interference a vertical tubular cavity portion (21) into which converges the conduit portion (20), comprising an inner core (22) and coaxial outer cylindrical wall (23); a cladding portion (28) in continuation of the vertical tubular cavity portion (21) and brace (29) that surrounds the stopper part (10) of the dispenser; and a distinct elastomeric valve (3) to close the vertical tubular cavity portion (21)

2 Claims, 2 Drawing Sheets

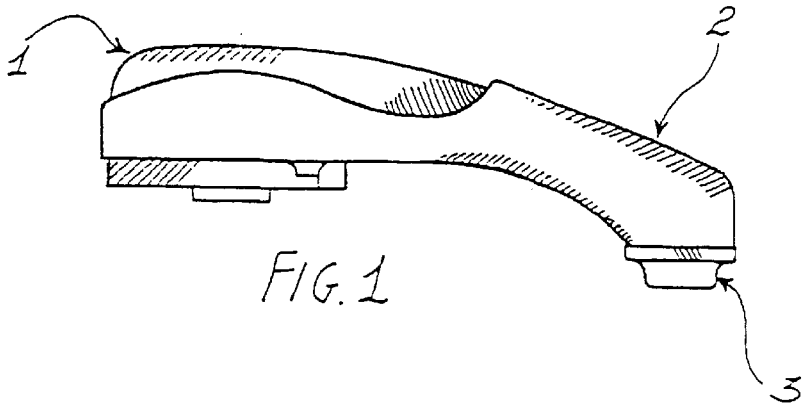
FIG. 1
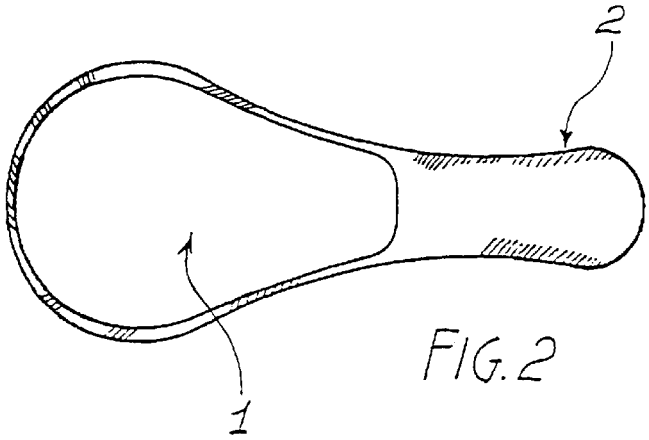
FIG. 2
FIG. 4
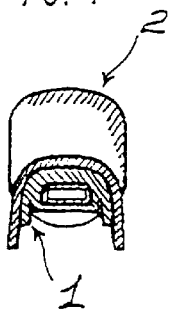
FIG. 3
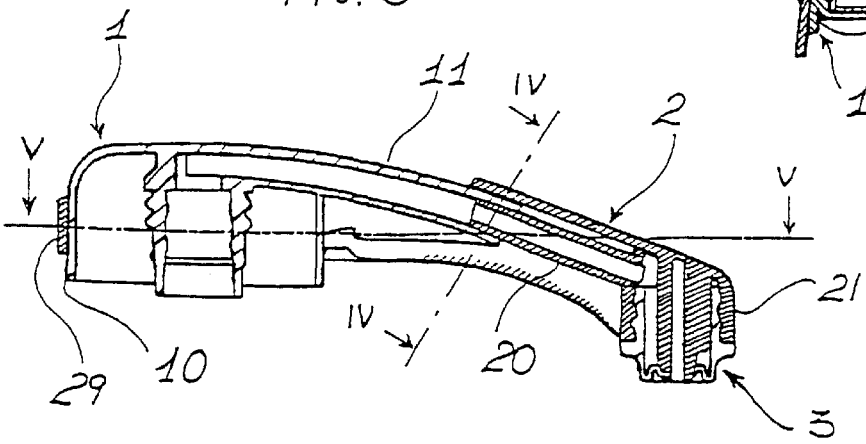

EXTENSION FOR BOTTLE DISPENSER, IN PARTICULAR FOR FOOD PRODUCTS

TECHNICAL FIELD

The present invention relates to an extension for bottle dispenser, in particular for food products.

In this field, the requirements to be met differ from those typical of the dispensing of cosmetic products, both from the ergonomic and function viewpoints. In particular, it is convenient for the spout of the dispenser to be considerably long and to allow a vertical dispensing of the fluid product. Especially in the foodstuffs field, moreover, to prevent the product from drying in contact with air, a system for sealing the outflow channel should be provided.

BACKGROUND ART

Currently, to meet such requirements in the dispensing of food products, long-spout dispensers are used, which provide for a substantially vertical dispensing action. A long spout is used because of the difficulty in obtaining, on hot-moulded components, curved paths for a fluid to be dispensed. In regard to the valves for sealing the outflow channel, they are infrequently used, although they would be useful in the foodstuffs field, because of their high cost, generally not compensated by the overall cost of the packaged product. In fact, known dispensers have a high number of components and the valve is generally cut after the moulding operation. Such a construction entails high costs due to the complexity of the cutting and assembly processes.

DISCLOSURE OF INVENTION

Therefore, the present invention aims to overcome the aforementioned drawbacks, providing an adapter for current conventionally produced dispensers. This would allow to use such dispensers in the foodstuffs field as well, hence obviating the need for studying and developing the production of dispensers dedicated to food products.

Therefore, the present invention provides an extension for bottle dispenser, in particular for food products, having a stopper part to be applied on the mouth of the bottle and provided with a spout which may be curved downwards, which, from a general point of view, is characterised in that it comprises, in a single piece:

- a conduit portion in continuation of the cavity of said spout into which it can be inserted with interference;
- a vertical tubular cavity portion into which said conduit portion converges, comprising an inner core and a coaxial external cylindrical wall;
- a cladding portion in continuation of said vertical tubular cavity portion, destined to cover said conduit portion and to continue in a brace that surrounds said stopper part of the dispenser; said brace having projecting portions for latching inferiorly to the dispenser; and
- a distinct elastomeric valve for closing said vertical tubular cavity portion.

DESCRIPTION OF THE DRAWINGS

Further characteristics and advantages of the present invention shall become more readily apparent from the detailed description that follows, of a preferred embodiment illustrated purely by way of non limiting example in the accompanying drawings, in which:

FIG. 1 is a lateral view of a dispenser with extension according to the present invention;

FIG. 2 is a top plan view of the dispenser of FIG. 1;

FIG. 3 is a longitudinal section of the dispenser of FIG. 1;

FIG. 4 is a section obtained according to the lines IV—IV of FIG. 3;

DESCRIPTION OF THE ILLUSTRATIVE EMBODIMENT

Figure 5:
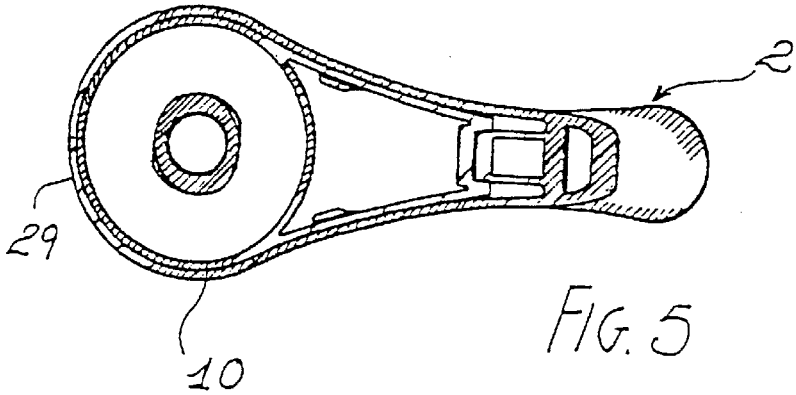
FIG. 5 is a section obtained according to the lines V—V of FIG. 3.

In the figures, the reference number 1 globally indicates a conventional dispenser and the reference number 2 indicates an extension according to the present invention.

The dispenser 1 has a stopper part 10 to be applied on the mouth of a bottle (not shown) and provided with a spout 11 curved slightly downwards. Since the dispenser is conventional in nature, it requires no further description.

The extension 2 comprises, in a single piece, a conduit portion 20, similar to a drinking straw, in continuation of the cavity of the spout 11 of the dispenser 1 into which it can be inserted with interference. The conduit portion 20 is perfectly blended with the spout 11.

Figure 7:
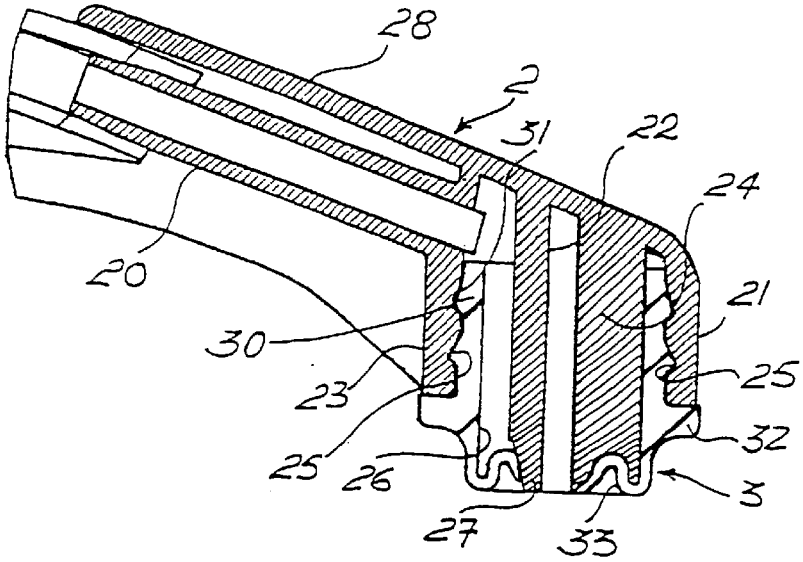
FIG. 7 is a partial, enlarged view of the extension shown in FIG. 3.

As FIG. 7 more clearly shows, the conduit portion 20 converges into a vertical tubular cavity portion 21, formed by an inner core 22, and by a coaxial outer wall 23. The tubular cavity 26 of the portion 21 is open downwards. The inner core 22, centrally holed, if desired, has three ribs at 120° (whereof one, visible in FIG. 7, is indicated with the reference number 24) and inferiorly a cone frustum shaped tapered profile 27. The outer wall 23 has holding indentations 25. The inner core 22 projects inferiorly from the ribs 24 with its cone frustum profile 27.

The vertical tubular cavity portion 21 continues in a cladding portion 28, destined to cover with a certain interspace the conduit portion 20 and to continue into a brace 29 which surrounds the stopper part 10 of the dispenser. The inter-space in the upper part between the cladding portion 28 and the conduit portion 20 is selected slightly lesser than the thickness of the spout 11 so that it co-operates in holding the extension 2 in the spout 11. As shown in FIG. 4, the cavity of the spout has rectangular section, but a different one can obviously be chosen.

Figure 6:
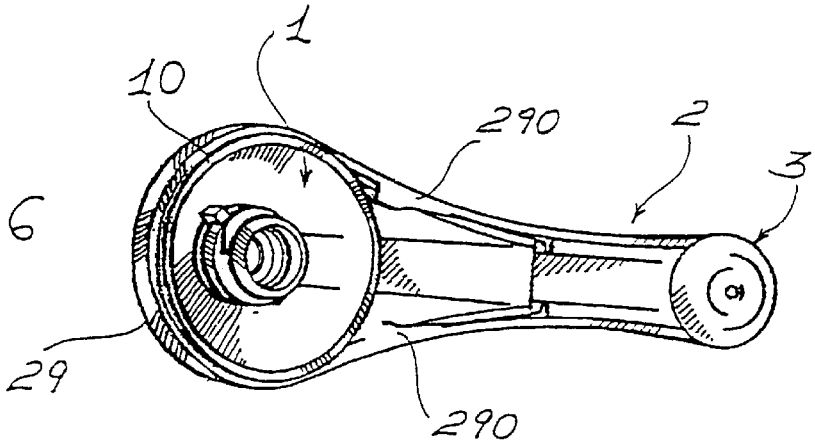
FIG. 6 is a bottom plan view of the dispenser of FIG. 1.

The brace 29 has projecting portions 290 which inferiorly latch onto the dispenser 1 (as FIG. 6 more clearly shows), and which serve to prevent the upward lifting of the brace portion, with its consequent undesired disengagement of the extension 2 from the dispenser 1.

The vertical tubular cavity portion 21 is closed inferiorly with an elastomeric valve 3. The valve 3 has a cylindrical tubular body portion 30, externally provided with engaging projections 31 which are inserted in the holding indentations 25 of the outer wall 23 of the vertical tubular cavity portion 21. The tubular body portion 30 has a flange 32 and a lid 33, centrally holed and elastically deformable. When bearing against the frustum cone profile 27 of the core 22, the lid 33 comes to form curved lips. Once inserted in the tubular cavity 26 of the extension portion 21, the valve 3 is also held internally by the 120° ribs 24 of the portion 21.

The fluid product supplied by the dispenser 1 advances in the spout 11, continues in the conduit portion 20 of the extension 2, and therefrom to the cavity portion 26. The pressure exerted against the lid 33 causes the central hole of the lid to be moved away, allowing the fluid product to flow out. When the fluid product is no longer supplied, the lid is repositioned with its curved lips on the cone frustum profile 26 of the core 22, perfectly sealing the extension 2 of the dispenser.

The invention thus conceived can be subject to numerous modifications and variations, without thereby departing from the scope of the inventive concept.

What is claimed is:

1. Extension for bottle dispenser having a stopper part (10) to be applied on a mouth of a bottle and provided with a spout (11) which can be curved downwards, characterised in that it comprises, in a single piece:

a conduit portion (20) in continuation of the cavity of said spout (11) into which the conduit portion can be inserted with interference;

a vertical tubular cavity portion (21) into which converges said conduit portion (20), the vertical tubular cavity portion comprising an inner core (22) and a coaxial outer cylindrical wall (23);

a cladding portion (28) in continuation of said vertical tubular cavity portion (21), destined to cover said conduit portion (20) and to continue in a brace (29) that surrounds said stopper part (10) of the dispenser; said brace (29) having projecting portions (290) for latching inferiorly to the dispenser; and a distinct elastomeric valve (3) for closing said vertical tubular cavity portion (21).

2. An extension as claimed in claim 1, characterised in that said elastomeric valve (3) comprises a flanged cylindrical body (30), provided externally with projections (31) for engaging with corresponding indentations (25) formed in said vertical tubular cavity portion (21), and a centrally holed, elastically deformable lid (33), inserted on the inner core (22) of the vertical tubular cavity portion (21).

* * * * *